US005410959A

United States Patent [19]

Sugiyama et al.

[11] Patent Number: 5,410,959

[45] Date of Patent: May 2, 1995

[54] PRINTING SWITCHING APPARATUS FOR SHEET-FED ROTARY PRESS WITH REVERSING MECHANISM

[75] Inventors: Hiroyuki Sugiyama; Yutaka Yuasa, both of Ibaragi, Japan

[73] Assignee: Komori Corporation, Japan

[21] Appl. No.: 270,148

[22] Filed: Jul. 1, 1994

[30] Foreign Application Priority Data

Jul. 5, 1993 [JP] Japan ..... 5-190978

[51] Int. Cl.[6] ..... B41F 21/10

[52] U.S. Cl. ..... 101/230; 101/248; 101/409; 101/246

[58] Field of Search ..... 101/142, 230, 231, 232, 101/233, 246, 248, 409

[56] References Cited

U.S. PATENT DOCUMENTS

| | | | |
|---|---|---|---|
| 3,896,724 | 7/1975 | Muselik | 101/248 |
| 4,444,106 | 4/1984 | Frenzel et al. | 101/230 |
| 4,457,231 | 7/1984 | Kawaguchi | 101/230 |
| 4,580,494 | 4/1986 | Becker | 101/230 |
| 4,716,827 | 1/1988 | Wieland et al. | 101/216 |
| 4,735,140 | 4/1988 | Wieland et al. | 101/230 |
| 4,831,929 | 5/1989 | Saito | 101/230 |
| 5,031,531 | 7/1991 | Becker | 101/230 |
| 5,265,528 | 11/1993 | Mathes | 101/230 |
| 5,365,845 | 11/1994 | Becker | 101/230 |

FOREIGN PATENT DOCUMENTS 146149 9/1990 Japan .

*Primary Examiner*—Eugene H. Eickholt

*Attorney, Agent, or Firm*—Blakely, Sokoloff, Taylor & Zafman

[57] ABSTRACT

A printing switching apparatus for a sheet-fed rotary press with a reversing mechanism includes a fixed gear, a rotary gear, a first inclined surface, an engaging member, and an actuating unit. The fixed gear is fixed to a shaft of a cylinder. The rotary gear is coaxial with the fixed gear, coupled to be driven with a cylinder adjacent to the cylinder, and phase-adjustable with respect to the fixed gear in a circumferential direction. The first inclined surface is formed on the rotary gear. The engaging member is movable with respect to the fixed gear and has a second inclined surface pressed against the first inclined surface of the rotary gear. The actuating unit moves the engaging means in a direction to be separated from or come close to the fixed gear, presses or releases the first inclined surface of the rotary gear and the second inclined surface of the engaging member against or from each other, and connects or disconnects rotational transmission between the fixed gear and the rotary gear.

11 Claims, 7 Drawing Sheets

PRINTING SWITCHING APPARATUS FOR SHEET-FED ROTARY PRESS WITH REVERSING MECHANISM

BACKGROUND OF THE INVENTION

The present invention relates to a printing switching apparatus, arranged in a sheet-fed rotary press with a reversing mechanism capable of performing both single-sided printing and perfecting printing, for adjusting circumferential phases of upstream and downstream cylinders with respect to a reversing cylinder in switching between single-sided printing and perfecting printing.

Various sheet-fed rotary presses each capable of performing single-sided printing and perfecting printing have been proposed and put into practice along with a variety of printing techniques. An example of such a rotary press is disclosed in Japanese Patent Laid-Open No. 4-146149 in which a transfer cylinder, a cylinder having a diameter twice that of the transfer cylinder, and a reversing cylinder are arranged between an upstream cylinder and a downstream cylinder along a paper convey direction. This rotary press will be described below.

FIG. 7 shows a cylinder arrangement in a single-sided printing state in the sheet-fed rotary press with a reversing mechanism, disclosed in this prior art. FIG. 8 shows a cylinder arrangement in a perfecting printing state in this press. Referring to FIGS. 7 and 8, a first impression cylinder 5 having a gripper unit 4 having grippers 2 and gripper pads 3 axially and parallelly arranged with the grippers 2 in a gap of the first impression cylinder 5 is pressed against a blanket cylinder 1 pressed against a plate cylinder (not shown) mounted with a plate. A second impression cylinder 10 having a gripper unit 9 having grippers 7 and gripper pads 8 axially and parallelly arranged with the grippers 7 in a gap of the second impression cylinder 10 is pressed against a blanket cylinder 6 pressed against a plate cylinder (not shown) mounted with a plate.

A transfer cylinder 11, a cylinder 12 having a diameter twice that of the transfer cylinder 11, and a reversing cylinder 13 are arranged to be pressed against each other between the first and second impression cylinders 5 and 10. A gripper unit 16 having grippers 14 and gripper pads 15 is axially arranged parallel to each other in a gap of the transfer cylinder 11.

Gripper units 19 and 20 respectively having grippers 17 and gripper pads 18 are axially and parallelly arranged in the gaps at positions which divide the circumference of the cylinder 12 into halves. The gripper units 19 and 20 are circumferentially movable.

Suckers 21 and 22 are connected to a blower through rotary valves or the like at positions which divide the circumference of the cylinder 12 into halves and are circumferentially phase-shifted from the gripper units 19 and 20 by about 45°. A gripper unit 25 having grippers 23 and gripper pads 24 and a gripper unit 28 having grippers 26 and gripper pads 27 are arranged in gaps of the reversing cylinder 13 at positions slightly phase-shifted in the circumferential direction of the reversing cylinder 13.

FIG. 9 shows the main part of a conventional printing switching apparatus. Referring to FIG. 9, a gear 32 circumferentially fixed with a key 31 is mounted on an end shaft 30 of the reversing cylinder 13 such that the axial movement of the fixed gear 32 is regulated by an end plate 33. A rotary gear 34 is pivotally mounted on the stepped portion of the fixed gear 32.

Reference numerals 35 denote a plurality of bolts 35 extending through holes **36*a* and 37*a* and holes 32*a* corresponding to the holes 36*a* and 37*a*. The holes 36*a* and 37*a* are formed at almost equal angular intervals of the circumferences of discs 36 and 37 formed to sandwich the fixed gear 32. The holes 32*a* are formed in the fixed gear 32. Nuts 38 are threadably engaged with the distal end threaded portions of the bolts 35. A friction plate 39 is interposed between the rotary gear 34 and the disc 37. A leaf spring 40 having an elastic force is interposed between the fixed gear 32 and the disc 36**.

On the other hand, a reduction gear group 43 is coupled to the motor shaft of a motor 42 arranged on a frame 41 side. A shaft **44*a* integral with a last gear 44 of the reduction gear group 43 is threadably engaged with a screw hole 41*a* of a frame 41. In the illustrated state, the fixed gear 32 and the rotary gear 34 are set stationary. When the motor 42 is rotated in this state, the reduction gear group 43 is rotated to feed the shaft 44*a* of the gear 44 by the function of the screw hole 41*a*, thereby urging the disc 36. The stationary state between the fixed gear 32 and the rotary gear 34 is released because the rotary gear 34 is locked by the frictional force of the frictional plate 39**.

Each cylinder is driven and coupled in accordance with the meshed state of a cylinder gear at the corresponding shaft end portion and the stationary state between the fixed and rotary gears 32 and 34. At the same time, the fixed gear 32 of the reversing cylinder 13 is meshed with the cylinder gear of the second impression cylinder 10, and the rotary gear 34 of the reversing cylinder 13 is meshed with the cylinder gear of the cylinder 12. For this reason, the stationary state between the fixed and rotary gears 32 and 34 of the reversing cylinder 13 is released. As a result, coupling between the upstream cylinder group including the reversing cylinder 12 and the downstream cylinder group including the reversing cylinder 13 is released.

With the above structure, in the single-sided printing mode shown in FIG. 7, when each cylinder is rotated, a paper sheet 29 printed between the blanket cylinder 1 and the first impression cylinder 5 is gripped between the gripper units 4 and 16 and then between the gripper unit 16 and the gripper units 19 and 20. The paper sheet 29 is wound on the upper-side surface of the cylinder 12.

When the leading end of the paper sheet 29 reaches a contact point between the cylinders 12 and 13, the paper sheet 29 is gripped from the gripper units 19 and 20 to the gripper unit 25 and is wound on the lower-side surface. The paper sheet 29 is then gripped to the gripper unit 9 of the second impression cylinder 10 and then conveyed. When the paper sheet 29 passes between the blanket cylinder 6 and the second impression cylinder 10, printing is performed on the previously printed surface.

When such single-sided printing is to be switched to perfecting printing, the motor 42 is rotated to move the gear shaft **44*a* of the gear 44 in accordance with the meshed state of the reduction gear group 43 and the screwing action of the screw hole 41*a*, thereby urging the disc 36. Therefore, the stationary state between the fixed gear 32 and the rotary gear 34** is released.

As shown in FIG. 8, the upstream cylinder group including the rotary gear 34 is rotated by the vertical length of the paper sheet 29 until the sucker 21 opposes the grippers 28, and the motor 42 is rotated in the reverse direction. In this case, the locked state between the rotary gear and the frictional plate 39 is released to set the fixed gear 32 and the rotary gear 34 in the stationary state.

Upon completion of this preparation, when perfecting printing is started, as shown in FIG. 8, the paper sheet 29 whose upper surface has been printed between the blanket cylinder 1 and the impression cylinder 5 is gripped between the gripper units 4 and 16 and then between the gripper unit 16 and the gripper units 19 and 20. As a result, the paper sheet 29 is wound on the upper-side surface of the cylinder 12.

In this state, when all the cylinders are continuously rotated, the leading end of the paper sheet 29 passes through the contact point between the cylinders 12 and 13. When the trailing end of the paper sheet 29 reaches the contact point between the cylinders 12 and 13, the sucker 21 draws this trailing end of the paper sheet 29. At the same time, the gripper unit 20 is opened to release the leading end of the paper sheet 29. The gripper unit 28 having the grippers 26 whose distal ends face in a direction to grip the paper sheet grips the trailing end of the paper sheet 29, thereby reversing and conveying the paper sheet 29.

During conveyance, the paper sheet 29 is gripped from the reversing gripper unit 28 to the gripper unit 25 facing in a direction to grip the paper sheet and then gripped to the gripper unit 9 of the second impression cylinder 10. The lower surface of the paper sheet 29 is printed while passing between the blanket cylinder 6 and the second impression cylinder 10, thereby performing perfecting printing.

The printing switching apparatus in the conventional sheet-fed rotary press with a reversing mechanism requires a large force enough to lock the fixed gear 32 and the rotary gear 34 without any slip. To release this locked state with a small force, the reduction gear group 43 and the like must be arranged between an operation member and the disc 36. This mechanism tends to be worn to cause a failure.

SUMMARY OF THE INVENTION

It is an object of the present invention to provide a printing switching apparatus for a sheet-fed rotary press with a reversing mechanism, capable of properly locking a fixed gear and a rotary gear with a small force.

In order to achieve the above object of the present invention, there is provided a printing switching apparatus for a sheet-fed rotary press with a reversing mechanism, comprising a fixed gear fixed to a shaft of a cylinder, a rotary gear, coaxial with the fixed gear, coupled to be driven with a cylinder adjacent to the cylinder, and phase-adjustable with respect to the fixed gear in a circumferential direction, a first inclined surface formed on the rotary gear, an engaging member movable with respect to the fixed gear and having a second inclined surface pressed against the first inclined surface of the rotary gear, and actuating means for moving the engaging means in a direction to be separated from or come close to the fixed gear, pressing or releasing the first inclined surface of the rotary gear and the second inclined surface of the engaging member against or from each other, and connecting or disconnecting rotational transmission between the fixed gear and the rotary gear.

DESCRIPTION OF THE PREFERRED EMBODIMENTS

Figure 1:
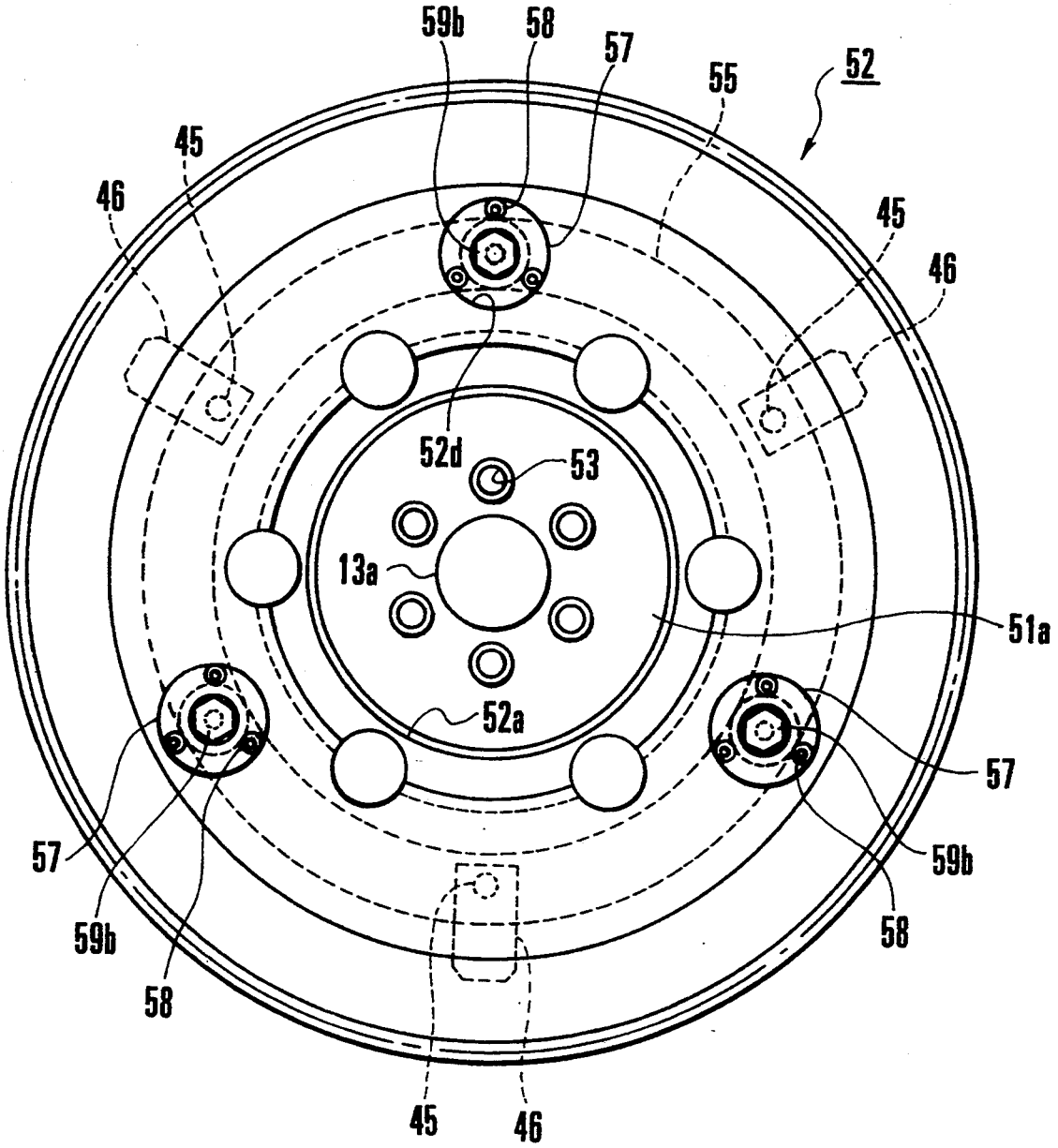
FIG. 1 is a front view of a printing switching apparatus for a sheet-fed rotary press with a reversing mechanism according to an embodiment of the present invention.
Figure 2:
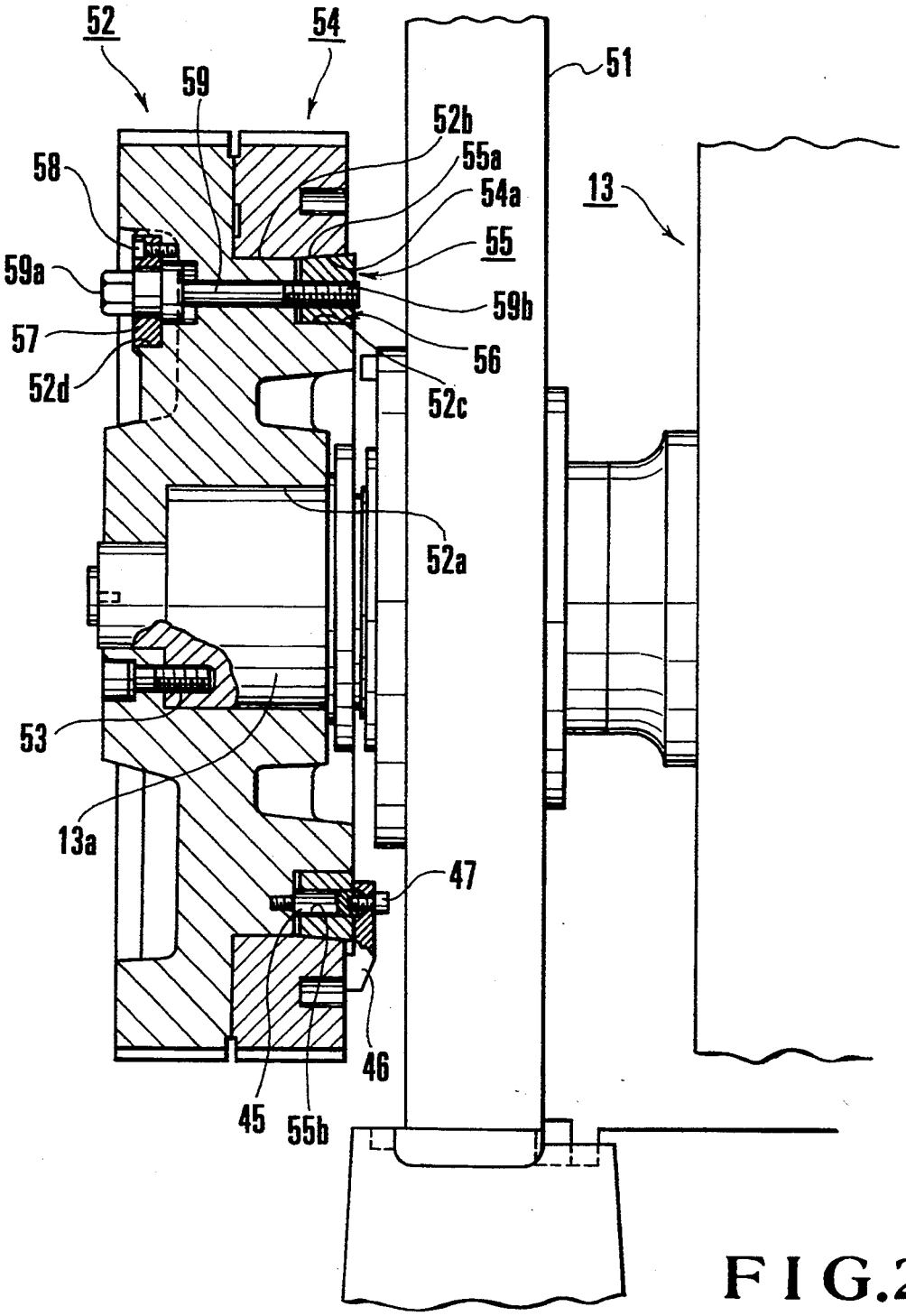
FIG. 2 is a longitudinal sectional view of the printing switching apparatus for the sheet-fed rotary press with the reversing mechanism of the embodiment shown in FIG. 1.
Figure 7:
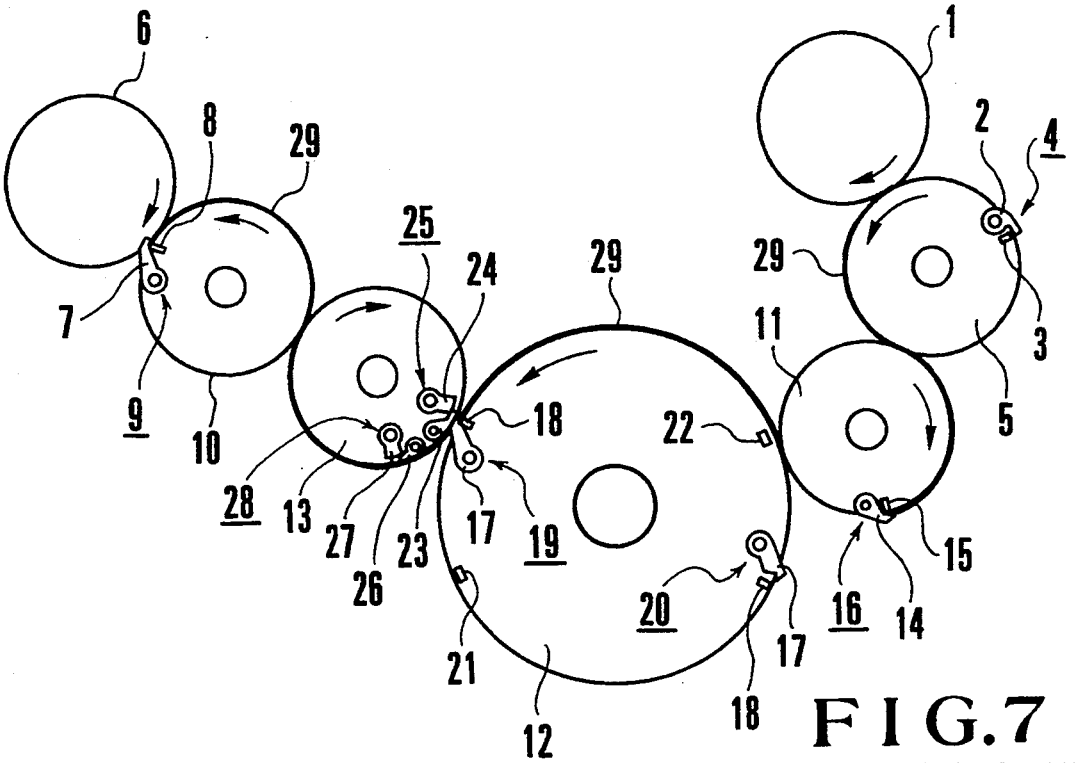
FIG.7 PRIOR ART
FIG. 7 is a view showing a cylinder arrangement so as to explain a single-sided printing operation.
Figure 8:
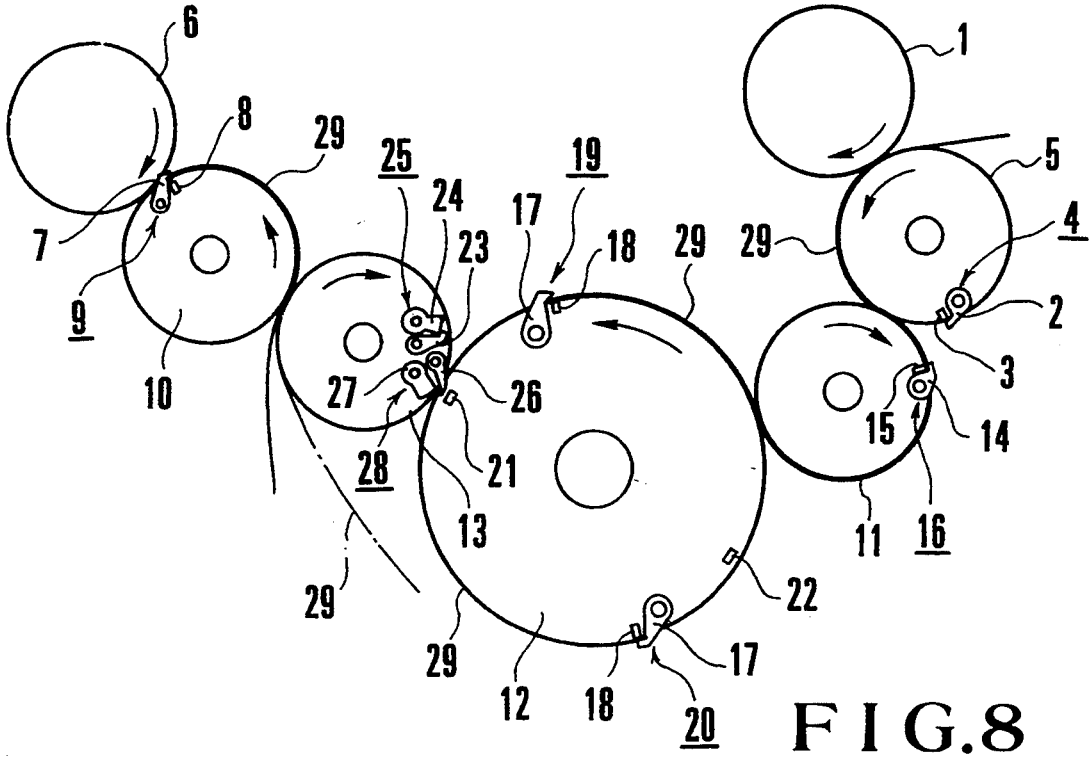
FIG.8 PRIOR ART
FIG. 8 is a view showing a cylinder arrangement so as to explain a perfecting printing operation.
Figure 9:
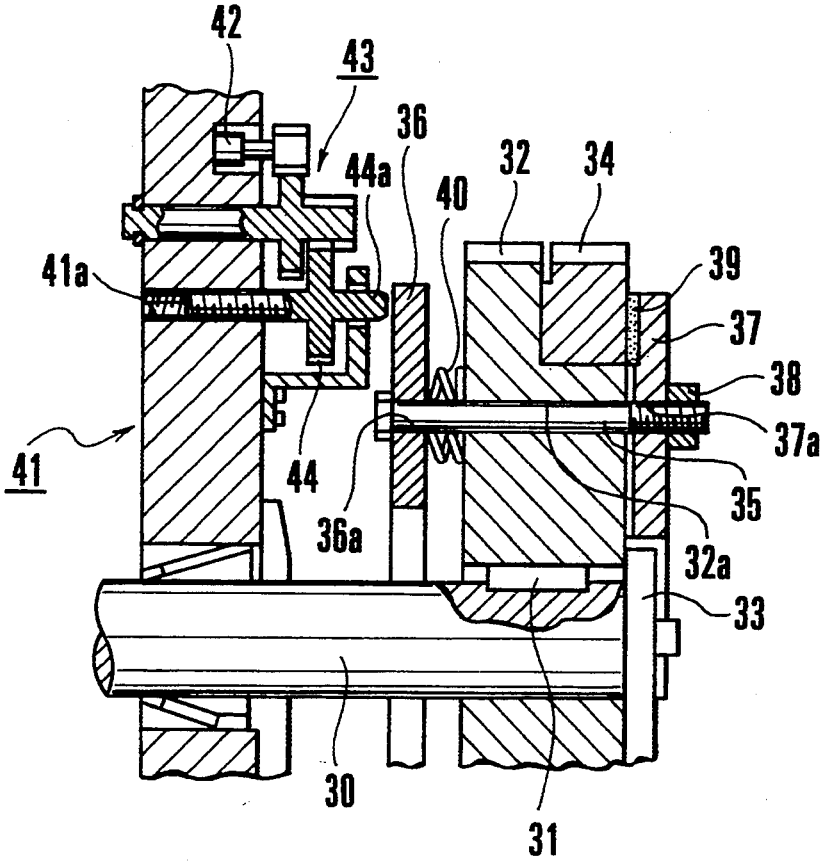
FIG.9 PRIOR ART
FIG. 9 is a longitudinal sectional view showing the main part of a printing switching apparatus for a sheet-fed rotary press with a reversing mechanism.

FIGS. 1 and 2 show a printing switching apparatus for a sheet-fed rotary press with a reversing mechanism according to an embodiment of the present invention. The cylinder arrangement and the single-sided and perfecting printing operations are the same as those in the apparatus shown in FIGS. 7 and 8, and a detailed description thereof will be omitted. The following embodiment will be described also with reference to FIGS. 7 and 8.

Referring to FIGS. 1 and 2, a fixed gear 52 having a stepped surface portion is fixed by a plurality of bolts 53 fitted in recessed holes **52*a* at an end shaft 13*a* of a reversing cylinder 13 axially supported by a frame 51. An annular rotary gear 54 is rotatably fitted on a small-diameter portion 52*b* on the outer circumferential surface of the fixed gear 52 on a frame 51 side. The fixed gear 52 is meshed with a cylinder gear (not shown) of a second impression cylinder 10 as a downstream cylinder with respect to the fixed gear 52. The rotary gear 54 is meshed with a cylinder gear (not shown) of a cylinder 12 having a diameter twice that of a transfer cylinder and serving as an upstream cylinder with respect to the rotary gear 54**.

An annular surface **54*a* inclined in the axial direction is formed in the inner circumferential surface, and an annular notch 52*c* is open to the inner end at the outer circumferential surface of the small-diameter portion 52*b* of the fixed gear 52. Reference numeral 55 denotes an annular taper ring having an almost square section. The taper ring 55 is fitted in an annular groove 56 surrounded by the annular inclined surface 54***a* of the rotary gear 54 and the notch 52*c* of the fixed gear 52. An annular inclined surface 55*a* having the same gradient as that of the annular inclined surface 54*a* is formed on the outer circumferential surface of the taper ring 55.

Recessed holes 52*d* having stepped portions are formed at positions which angularly and equally divide the side surface having no stepped portions 52*b* of the fixed gear 52. Bearings 57 are respectively fitted in these recessed holes 52*d* and fixed with a plurality of bolts 58. Reference numeral 59 denotes a bolt inserted into the hole of the corresponding bearing 57 and the hole of the fixed gear 52 and fixed in the axial direction. Each bolt 59 serves as a pivotally held actuating means. A distal end threaded portion 59*b* of each bolt 59 is threadably engaged with a corresponding screw hole formed in the side surface of the taper ring 55. When a wrench is engaged with a head portion 59*a* of each bolt 59 and turned, the taper ring 55 is moved back and forth in the axial direction of the fixed gear 52 in accordance with the screw feed action of the corresponding threaded portion 59*b*. By the action of the annular inclined surface 55*a* of the taper ring 55, the taper ring 55 can be engaged in or disengaged from the annular groove 56 surrounded by the annular inclined surface 54*a* of the rotary gear 54 and the notch 52*c* of the fixed gear 52. For this reason, the gears 52 and 54 are locked with or released from each other.

Holes 55*b* axially extending through the taper ring 55 are formed at three positions each dividing a distance between the adjacent holes of the bolts 59 into halves, and pins 45 are inserted into these holes 55*b* and threadably engaged with the screw holes of the fixed gear 52. Stoppers 46 for preventing removal of the taper ring 55 are fixed to the pins 45 with bolts 47, respectively.

The operation of the printing switching apparatus having the above structure will be described below. When the printing mode is to be changed from the single-sided printing described with reference to FIG. 7 to perfecting printing described with reference to FIG. 8, transfer of a paper sheet 29 at a position where gripper units 19 and 25 oppose each other in single-sided printing must be changed to transfer of the paper sheet 29 at a position where a sucker 21 opposes the reversing gripper unit 28 in perfecting printing. For this reason, the phase of the upstream cylinder group including the cylinder 12 must be shifted from that of the downstream cylinder group including the reversing cylinder 13 by an almost vertical length of the paper sheet 29.

When the wrenches are engaged with the head portions 59*a* of the three bolts 59, respectively, and loosened, the taper ring 55 having the screw holes engaged with the distal end threaded portions 59*b* of the bolts 59 pops up from the annular groove 56 toward the frame 51 side by the action of the screw feed action. For this reason, tight contact between the inclined surface 54*a* of the rotary gear 54 and the inclined surface 55*a* of the taper ring 55 is released. Since the rotary gear 54 is pivotal, the upstream gear group including the rotary gear 54 is moved by almost the vertical length of the paper sheet 29. When the bolts 59 are then fastened, the taper ring 55 is moved in the annular groove 56 and is fixed at a position where the inclined surface 54*a* of the rotary gear 54 is pressed against the inclined surface 55*a* of the taper ring 55. When the rotary gear 54 having the inclined surface 54*a* is systematically coupled by the taper ring 55 having the inclined surface 55*a*. Therefore, the gears 52 and 54 can be firmly locked with each other with a small force.

Figure 3:
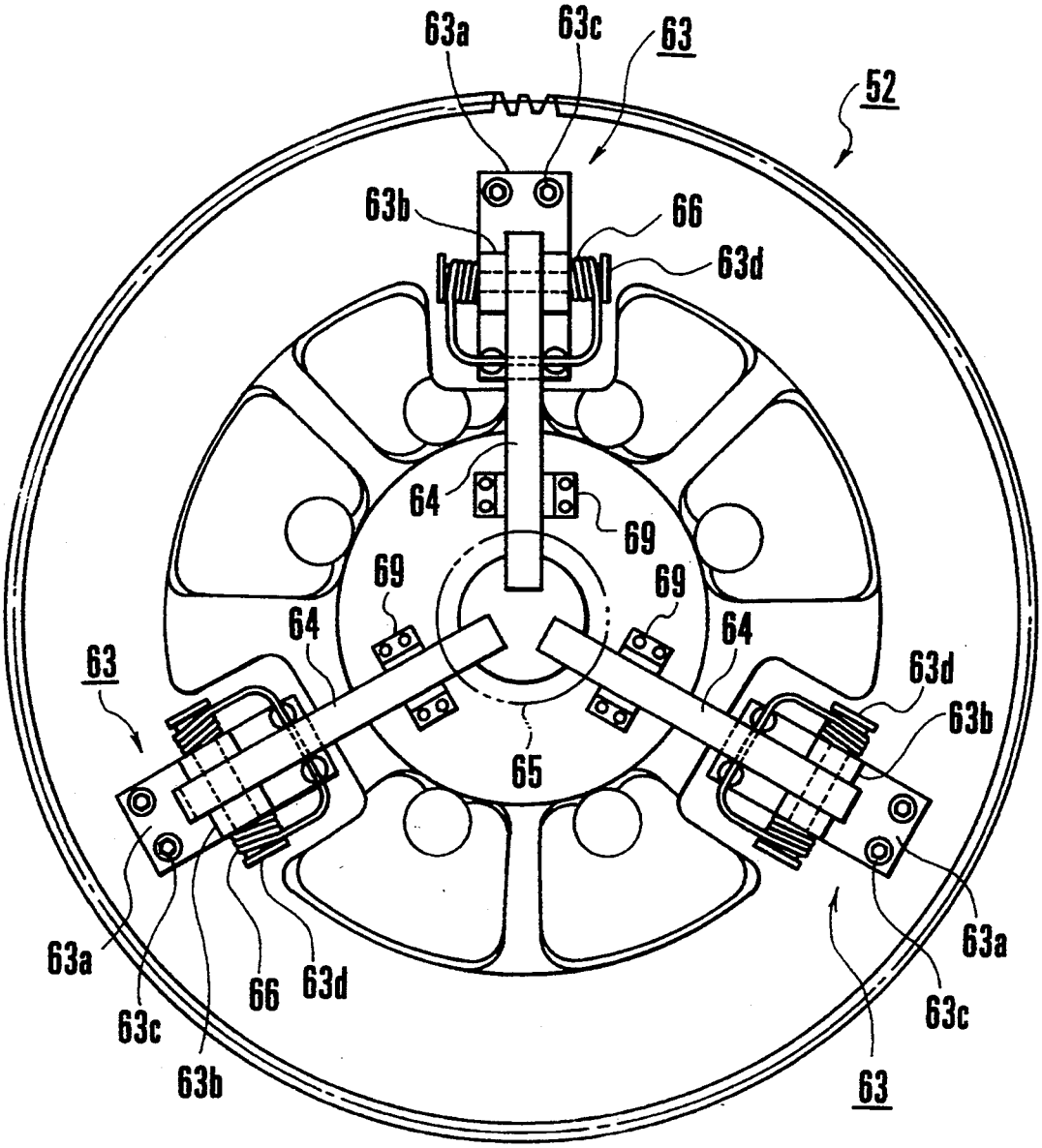
FIG. 3 is a front view showing a printing switching apparatus for a sheet-fed rotary press with a reversing mechanism according to another embodiment of the present invention.
Figure 4:
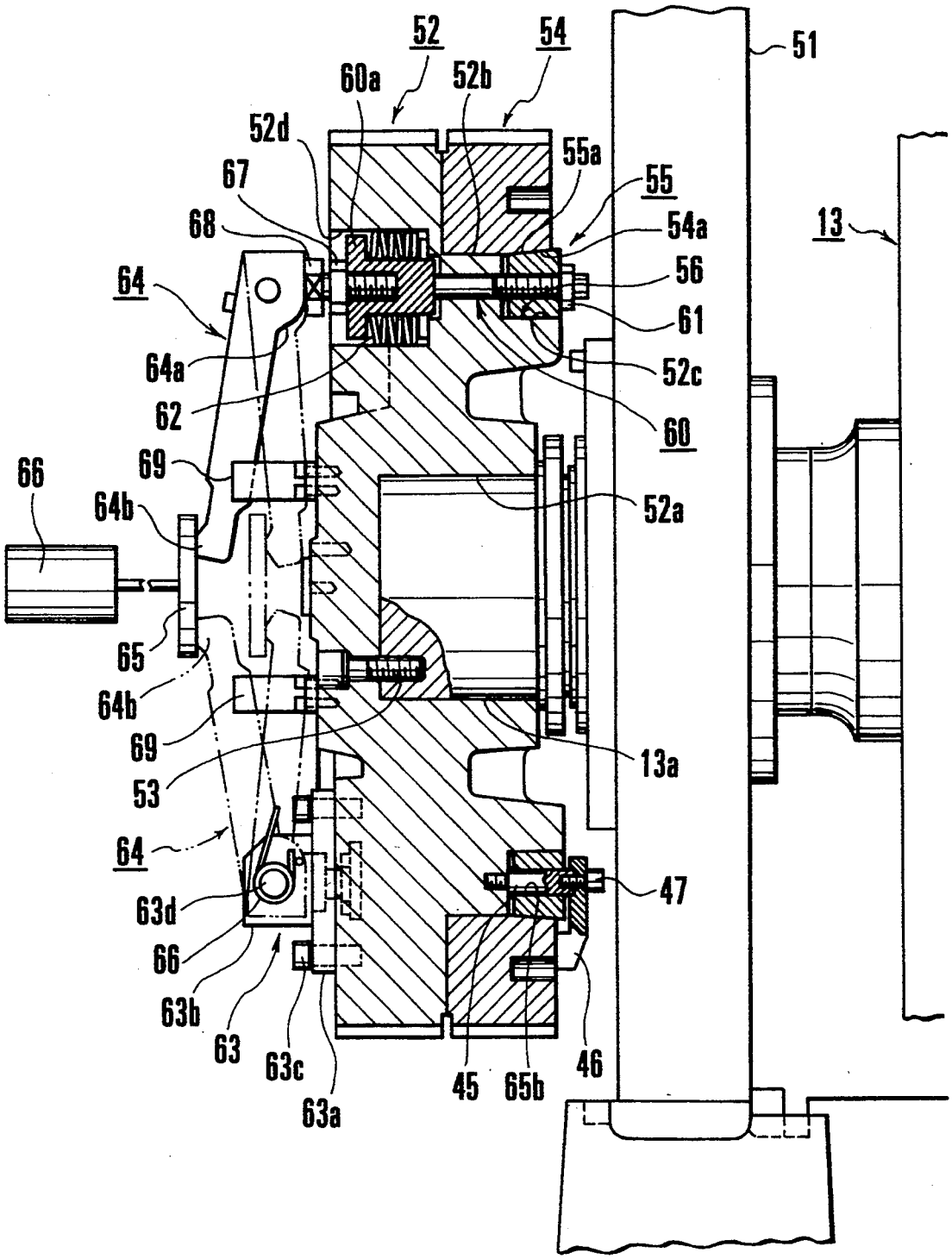
FIG. 4 is a longitudinal sectional view showing the printing switching apparatus for the sheet-fed rotary press with the reversing mechanism of the embodiment shown in FIG. 3.

FIGS. 3 and 4 show a printing switching apparatus for a sheet-fed rotary press with a reversing mechanism according to another embodiment of the present invention. The same reference numerals as in FIGS. 1 and 2 denote the same parts in FIGS. 3 and 4, and a detailed description thereof will be omitted.

In this embodiment, three screw holes at equal angular intervals are formed in the taper ring 55 shown in FIGS. 1 and 2. Screw shafts 60 serving as reciprocal members having head portions 60*a* having stepped portions are threadably engaged with the holes formed in the side surface of a fixed gear and are fastened by nuts 61. Three concentric spring holes 52*d* are formed at equal angular intervals in a side surface of a fixed gear 52 which does not have the taper ring 55. Three coned disc springs 62 for moving the taper ring 55 toward an annular groove 56 through the screw shafts 60 to lock gears 52 and 54 are interposed between the collars of the head portions 60*a* of the screw shafts 60 and the bottom surfaces of the spring holes 52*d*, respectively.

Each bearing 63 integrally consisting of a base 63*a* and a pair of bearing plates 63*b* extending from the base 63*a* is fixed by a plurality of bolts 63*c* on the side surface of the fixed gear 52 from which the spring holes 52*d* are open, so that the bearings 63 cause the bases 63*a* to close the openings of the spring holes 52*d*, respectively. Levers 64 having free end portions 64*b* are pivotally supported on the bearing plates 63*b* of the bearings 63 through pins 63*d*, respectively. These three levers 64 corresponding to the spring holes 52*d* have the free end portions 64*b* opposing each other at the central portion of the fixed gear 52. These free end portions 64*b* are operated by drive units 66 such as air cylinders and engaged with a disc member 65 serving as a pressing member reciprocated in the axial direction of the fixed gear 52.

Torsion springs 66 are respectively mounted on the pins 63*d* for supporting the levers 64 in a direction to separate the free end portions 64*b* from the fixed gear 52, i.e., in a direction to cause the taper ring 55 to lock the gears 52 and 55 with the elastic forces of the coned disc springs 62. Bolts 68 reciprocally inserted into the screw holes formed in the head portions 60*a* and fixed by nuts 67 are formed at the head portions 60*a* of the screw shafts 60.

Arcuated cams 64*a* are formed at the support end portions of the levers 64 which abut against the head portions of the bolts 68. When the levers 64 are swung, the screw shafts 60 are reciprocated through the coned disc springs 62 and the bolts 68. Reference numerals 69 denote guides, fixed to the side surface of the fixed gear 52, for guiding the swinging motions of the levers 64.

The operation of the printing switching apparatus having the above structure will be described below. When the printing mode is to be changed from the single-sided printing described with reference to FIG. 7 to perfecting printing described with reference to FIG. 8, transfer of a paper sheet 29 at a position where gripper units 19 and 25 oppose each other in single-sided printing must be changed to transfer of paper sheet 29 at a position where a sucker 21 opposes a reversing gripper unit 28 in perfecting printing. For this reason, the phase of the upstream cylinder group including a cylinder 12 must be shifted from that of the downstream cylinder group including a reversing cylinder 13 by an almost vertical length of the paper sheet 29.

In the illustrated state, when drive units 66 such as air cylinders are operated to push the disc member 65 to a position indicated by a chain double-dashed line in a direction to cause the disc member 65 as a pressing member to come close to the fixed gear 52, the three levers 64 are swung to the chain double-dashed line against the elastic forces of the torsion springs 66. The screw shafts 60 are pushed by cams 64*a* of the levers 64 against the biasing forces of the coned disc springs 52*d* through the bolts 68. The taper ring fixed at the distal end portions of the screw shafts 60 is removed from the annular groove 56. An inclined surface 54*a* of a rotary gear 54 is released from an inclined surface 55*a* of the taper ring 55, so that the rotary gear 54 can rotate.

The upstream gear group including the rotary gear 54 is moved by almost the vertical length of the paper sheet 29, and the drive units 66 are operated in a reverse direction. The three levers 64 are simultaneously swung, and the small-diameter portions of the cams 64*a* oppose the head portions of the bolts 68. The screw shafts 60 are restored to the initial positions by the elastic forces of the coned disc springs 62, and the taper ring is fitted into the annular groove 57. The inclined surface 54*a* of the rotary gear 54 is pressed against the inclined surface 55*a* of the taper ring 55 at a predetermined position, thereby locking the gears 52 and 54 with each other.

According to this embodiment, the taper ring 55 is used in combination with the levers 64. The gears 52 and 54 can be simultaneously locked with or released from each other. In addition, by the lever action, the gears 53 and 54 can be released from each other with a small force.

Figure 5:
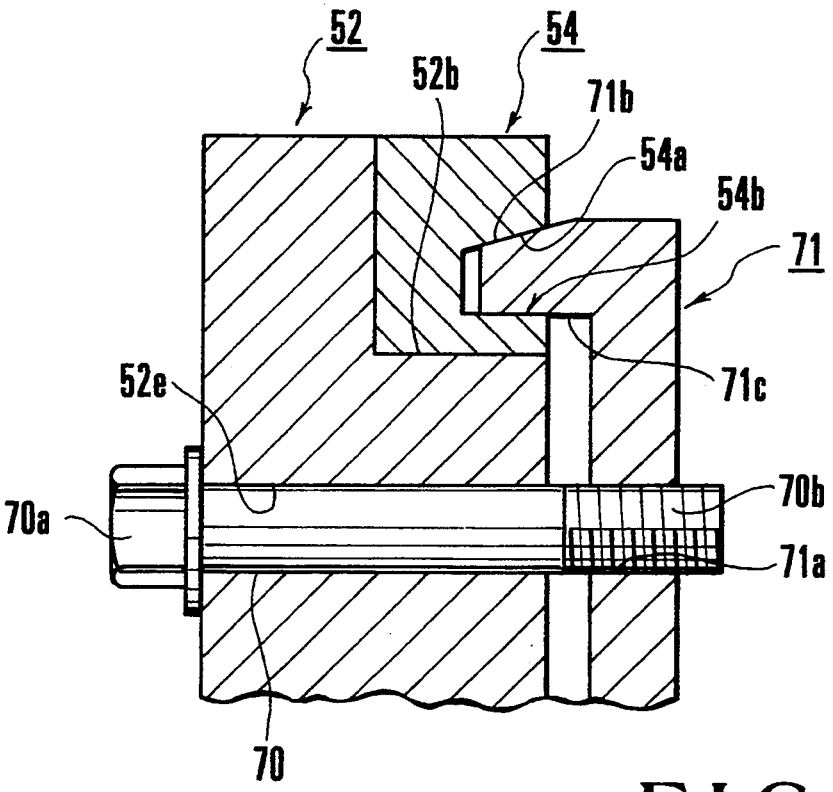
FIG. 5 is a sectional view showing the main part of a fixed gear and a rotary gear in a printing switching apparatus for a sheet-fed rotary press with a reversing mechanism according to still another embodiment of the present invention.

FIG. 5 shows the outer circumferential portion between fixed and rotary gears in a printing switching apparatus according to still another embodiment of the present invention. An annular rotary gear 54 having an almost square section is pivotally mounted on a small-diameter portion 52*b* of a fixed gear 52 fixed at an end shaft of a reversing cylinder 13. Each bolt 70 serving as an actuating means is pivotally inserted in a corresponding one of a plurality of bolt holes 52*e* formed in the side surface of the fixed gear 52.

A distal end threaded portion 70*b* of each bolt 70 is threadably engaged with a disc member 71 serving as an engaging member having a flange portion 71*c* on its circumferential portion. An inclined surface 71*b* inclined in the axial direction of the disc member 71 is formed on the outer circumferential surface of the flange portion 71*c* of the disc member 71.

On the other hand, an annular groove 54*b* is formed in a side surface of the rotary gear 54 which opposes the disc member 71, and an inclined surface 54*a* is formed on the outer circumferential side of the groove 54*b* and pressed against the inclined surface 71*b* of the disc member 71. When the head portion 70*a* of each bolt 70 is pivoted and fastened, the disc member 71 is moved in a direction to come close to the fixed gear 52 by the screw feed action of the distal end threaded portion 70*b* of the corresponding bolt 70. The fixed and rotary gears 52 and 54 are locked with each other in accordance with an wedging action between the inclined surface of the rotary gear 54 and the inclined surface 71*b* formed on the flange portion 71*c* of the disc member 71.

With the above structure, when the printing mode is to be switched from, e.g., single-sided printing to perfecting printing, the bolts 70 are pivoted and loosened, the disc members 71 are moved in a direction to be separated from the fixed gear 52 in accordance with the screw feed actions of the distal end threaded portions 70*b*. The inclined surface 54*a* of the rotary gear 54 is released from the inclined surfaces 71*b* of the disc members 71, so that the rotary gear 54 is set rotatable. In this state, when the rotary gear 54 is rotated, the phase of the reversing cylinder 13 belonging to the upstream cylinder group in the paper convey direction including a cylinder 12 having a diameter twice that of the transfer cylinder can be adjusted.

After the phase adjustment, when the bolts 70 are pivoted in the reverse direction, the disc members 71 are moved in a direction to come close to the fixed gear 52, and the fixed and rotary gears 52 and 54 are locked with each other by the action between the inclined surfaces 54*b* and 71*b* opposing each other. In this case, the gears 52 and 54 can be firmly locked with each other with a small force in accordance with the wedging action.

Figure 6:
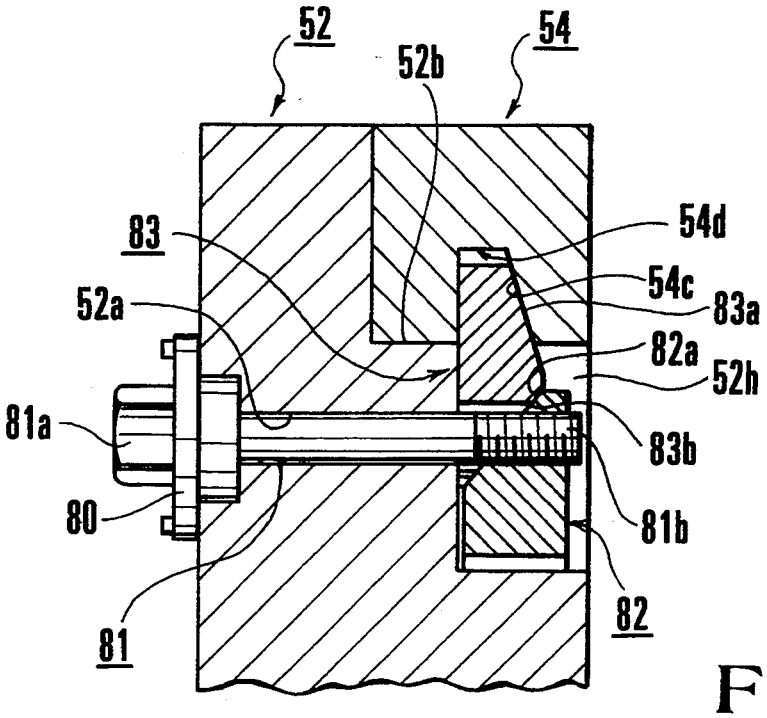
FIG. 6 is a sectional view showing the main part of a fixed gear and a rotary gear in a printing switching apparatus for a sheet-fed rotary press with a reversing mechanism according to still another embodiment of the present invention.

FIG. 6 shows the circumferential portion between fixed and rotary gears in a printing switching apparatus according to still another embodiment of the present invention. An annular rotary gear 54 having an almost square section is pivotally fitted on a small-diameter portion 52*b* of a fixed gear 52 fixed on an end shaft of a reversing cylinder 13. A bolt 81 serving as an actuating means is pivotally inserted into each bearing 80 and each of a plurality of bolt holes 52*a* formed in the side surface of the fixed gear 52.

A block member 82 serving as an actuating means having an inclined surface 82*a* inclined in the axial direction of a corresponding bolt 81 is stored in a recessed hole 52*h* corresponding to each of the bolts 81 in the side surface of the fixed gear 52 in such a manner that the screw hole is threadably engaged with a screw hole 81*b* of the corresponding bolt 81. The pivotal motion of the block member 82 regulated by the wall surfaces of the recessed hole 52*h*.

On the other hand, a groove 54*d* having an inclined surface 54*c* inclined in the radial direction of the rotary gear 54 is formed in the inner circumferential surface of the rotary gear 54. A gripper member 83 serving as an engaging member having an inclined surface 83*a* pressed against the inclined surface 54*c* of the groove 54*d* and an inclined surface 83*b* pressed against the inclined surface 82*a* of the block member 82 is fitted in the groove 54*d*.

With the above structure, when the printing mode is to be changed from, e.g., single-sided printing to perfecting printing, when a head portion 81*a* of each bolt 81 is pivoted and loosened, the block member 82 is moved in a direction to be separated from the fixed gear 52 by the screw action of the distal end threaded portion 81*b*, and the inclined surface 82*a* of the block member 82 is released from the inclined surface 83*b* of the gripper member 83. As a result, the gripper member 83 is moved in a direction toward the center of the gears 52 and 54, and the inclined surface 54*c* of the rotary gear 54 is released from the inclined surface 83*a* of the gripper member 83, so that the rotary gear 54 is set rotatable. In this state, when the rotary gear 54 is rotated, the phase of the reversing cylinder 13 belonging to the upstream cylinder group in the paper convey direction including a cylinder 12 having a diameter twice that of a transfer cylinder can be adjusted.

After completion of the phase adjustment, when each bolt 81 is rotated in the reverse direction, the block member 82 is moved in a direction to come close to the fixed gear 54. The gripper member 83 is moved in a direction to be separated from the center of the gears 52 and 54 when the inclined surface 82*a* of the block member 82 is pressed against the inclined surface 83*b* of the gripper member 83. The inclined surface 83*a* of the gripper member 83 is pressed against the inclined surface 54*c* of the groove 54*d* of the rotary gear 54, so that the fixed and rotary gears 52 and 54 are firmly fixed with a small force.

In the above embodiment, a double gear consisting of the fixed gear 52 and the rotary gear 54 is mounted on the shaft 13*a* of the reversing cylinder 13. This double gear may be mounted on another cylinder. For example, a double gear is mounted on the shaft of the cylinder 12 shown in FIG. 7, and one fixed gear is mounted on the shaft of the reversing gear 13 to switch the printing mode from single-sided printing to perfecting printing. That is, a cylinder on which the fixed gear 52 and the rotary gear 54 are mounted is the reversing gear 13 or any cylinder which is adjacent to the reversing gear 13 and disposed on the upstream side thereof.

In each embodiment described above, only one rotary gear 54 is arranged. However, a plurality of rotary gears may be arranged. An engaging member for pressing an inclined surface against the rotary gear need not be an annular engaging member. A plurality of gripper engaging portions in the embodiment of FIG. 6 may be arranged.

In each embodiment described above, the inclined surface is formed in one side of the engaging member. However, both sides of the engaging member may have inclined surfaces having opposite gradients. In this case, in the embodiment shown in each of FIGS. 2 and 4, inclined surfaces: are formed on the outer and inner circumferential surfaces of the taper ring 55. At the same time, inclined surfaces are formed on the inner circumferential surface of the rotary gear 54 and the annular surface of the notch 52*c* of the fixed gear 52. In the embodiment shown in each of FIGS. 5 and 6, the opposing surfaces of the annular grooves 54*b* and 54*d* of the rotary gear 54 are constituted by the inclined surfaces, the outer and inner circumferential surfaces of the flange portion 71*c* of the disc member 71 and the two radial surfaces of the gripper member 83 are constituted by inclined surfaces, respectively.

In addition, in the embodiment shown in FIGS. 3 and 4, the levers 64 are arranged to release the gears 52 and 54 from each other. The gears 52 and 54 are locked with each other by the biasing forces of the coned disc springs 52*d*. However, the coned disc springs may be omitted. In this case, the lever 64 may be directly coupled to the screw shaft 60 to lock or release the gears 52 and 54 with or from each other.

As can be apparent from the above description, according to the present invention, an engaging member whose inclined surface is pressed against that of a rotary gear to lock the rotary gear and a fixed gear with each other is arranged between the rotary and fixed gears. This engaging member is moved to press the opposing inclined surfaces against each other or release them from each other. Both the gears can be firmly locked with each other in accordance with a wedging action. In addition, the locked state can be canceled with a small force. A load acting on each constituent member can be reduced, and the durability and operability of the apparatus can be improved.

A plurality of levers for simultaneously reciprocating engaging members through a plurality of reciprocating members. The inclined surface of the engaging member can be pressed against the inclined surface of the rotary gear with a small force in accordance with the lever action. Therefore, the operability can be improved, a load acting on each constituent member can be reduced, and durability of the apparatus can be improved.

What is claimed is:

1. A printing switching apparatus for a sheet-fed rotary press with a reversing mechanism, comprising:

a fixed gear fixed to a shaft of a cylinder;

a rotary gear, coaxial with said fixed gear, coupled to be driven with a cylinder adjacent to said cylinder, and phase-adjustable with respect to said fixed gear in a circumferential direction;

a first inclined surface formed on said rotary gear;

an engaging member, movable with respect to said fixed gear and having a second inclined surface pressed against said first inclined surface of said rotary gear; and actuating means for moving said engaging means in a direction to be separated from or come close to said fixed gear, pressing or releasing said first inclined surface of said rotary gear and said second inclined surface of said engaging member against or from each other, and connecting or disconnecting rotational transmission between said fixed gear and said rotary gear.

2. An apparatus according to claim 1, wherein said fixed gear has an annular small-diameter stepped portion on a circumferential surface of said fixed gear, and said rotary gear has an annular shape and is rotatably held on an outer circumferential surface of said small-diameter stepped portion of said fixed gear.

3. An apparatus according to claim 2, wherein said fixed gear has an annular notch formed on said outer circumferential surface of said small-diameter stepped portion, said first inclined surface comprises an annular surface formed on an inner circumferential surface of said rotary gear to be inclined in an axial direction of said fixed gear, and said engaging member comprises an annular taper ring having an outer circumferential surface whose second inclined surface has the same gradient as that of said first inclined surface, so that said taper ring reciprocates, in an axial direction of said fixed gear, in an annular groove constituted by said notch of said fixed gear and said first inclined surface of said rotary gear, thereby pressing or releasing said second inclined surface against or from said first inclined surface.

4. An apparatus according to claim 3, wherein said actuating means comprises a plurality of feed screw members having distal end threaded portions rotatably held at positions which equally divide a side surface of said fixed gear in the circumferential direction, said threaded portions being threadably engaged with said engaging member, so that said engaging member is reciprocated in the axial direction of said fixed gear upon rotation of said feed screw members.

5. An apparatus according to claim 3, wherein said actuating means comprises reciprocal members reciprocally held at positions which equally divide a side surface of said fixed gear in the circumferential direction, said engaging member being fixed at a distal end of each of said reciprocal members, so that said engaging member is reciprocated in the axial direction of said fixed gear in accordance with a reciprocal motion of said reciprocal members.

6. An apparatus according to claim 5, wherein said actuating means comprises a plurality of lever members arranged in correspondence with said reciprocal members and swung to press said reciprocal members, and pressing means for simultaneously pressing and swinging said lever members.

7. An apparatus according to claim 5, wherein further comprising a plurality of spring members for biasing said reciprocal members in a direction to press said first inclined surface of said rotary gear against said second inclined surface of said engaging member.

8. An apparatus according to claim 2, wherein an annular groove having said first inclined surface inclined in the axial direction of said fixed gear is formed in a side surface of said rotary gear, and said engaging member comprises a disc member movable in the axial direction of said fixed gear and having an annular flange portion having said second inclined surface, so that said flange portion of said disc member is engaged with or disengaged from the groove formed in said rotary gear, thereby pressing or releasing said second inclined surface of said disc member against or from said first inclined surface of said rotary gear.

9. An apparatus according to claim 2, wherein an annular groove having said first inclined surface inclined in the radial direction of said fixed gear is formed in an inner circumferential surface of said rotary gear, a plurality of recesses are formed in an outer circumferential surface of said small-diameter stepped portion of said fixed gear at predetermined intervals, and said engaging means comprises a plurality of gripper members arranged in said recesses of said fixed gear and having said second inclined surfaces in contact with said annular first inclined surfaces at a predetermined interval, and a plurality of block members inclined in the axial direction of said fixed gear and each having a third inclined surface for pressing said gripper members in the radial direction of said fixed gear, so that said block members are simultaneously moved by said actuating means in the axial direction of said fixed gear to move said gripper members in the radial direction of said fixed gear, and said gripper members are engaged with or disengaged from, at a predetermined interval, the groove formed in said rotary gear to press or release said second inclined surface of said gripper member against or from said first inclined surface of said rotary gear.

10. An apparatus according to claim 1, wherein said rotary gear has a third inclined surface having a gradient opposite to that of said first inclined surface, and said engaging member has a fourth inclined surface having a gradient opposite to that of said second inclined surface, so that said first and third inclined surfaces of said rotary gear are respectively pressed against said second and fourth inclined surfaces of said engaging member.

11. An apparatus according to claim 1, wherein said second inclined surface of said engaging member is pressed against said first inclined surface of said rotary gear at the same gradient.

* * * * *